United States Patent [19]

Walker et al.

[11] 3,945,426

[45] Mar. 23, 1976

[54] SPLASH CAN FOR INGOT MOLDS AND METHODS

[75] Inventors: Andrew Walker, Upland; Charles Frederick Long, Rialto; Harry Davies Birks, Cherry Valley, all of Calif.

[73] Assignee: Kaiser Steel Corporation, Oakland, Calif.

[22] Filed: Dec. 19, 1974

[21] Appl. No.: 534,175

[52] U.S. Cl. ..... 164/137; 249/206

[51] Int. Cl.[2] ..... B22D 7/12

[58] Field of Search ..... 164/137; 249/204, 206, 249/205

[56] References Cited

UNITED STATES PATENTS

| | | | |
|---|---|---|---|
| 2,810,170 | 10/1957 | Pearce | 249/206 X |
| 2,910,747 | 11/1959 | Sterick et al. | 249/206 |
| 3,857,438 | 12/1974 | Snowdon | 249/206 |

FOREIGN PATENTS OR APPLICATIONS

| | | | |
|---|---|---|---|
| 477,967 | 1945 | Canada | 249/206 |

*Primary Examiner*—Ronald J. Shore
*Attorney, Agent, or Firm*—Naylor, Neal & Uilkema

[57] ABSTRACT

A splash can for placement in a mold before pouring molten metal into the mold, so as to eliminate scab producing splashes during pouring into the ingot mold. The top of the mold typically has a mouth of reduced diameter and the splash can of the present invention is of cylindrical form having a diameter greater than the mouth. The can is formed from material compatible with the molten material and deformable so that the can can be folded for introduction into the ingot mold through the mouth without exceeding the elastic limit of the material. The can is retained in the folded position by a tension member that is wrapped therearound; after the folded can is introduced into the mold, the tension member is severed whereupon the can springs into a generally cylindrical shape within the mold.

8 Claims, 4 Drawing Figures

SPLASH CAN FOR INGOT MOLDS AND METHODS

FIELD OF THE INVENTION

This invention relates to ingot molding and, more particularly, to a splash can and method for installing it into an ingot mold to eliminate splashing during the pouring of molten metal into the mold.

DESCRIPTION OF THE PRIOR ART

Canadian Pat. No. 477,967 contains a description of the phenomena by which ingot scabs are formed during pouring of the same. The Canadian Patent also discloses one form of splash can or mold liner of spiral form which is said to ameliorate the situation. Because the patented device employs plural convolutions of steel, it is very heavy and expensive as well as being difficult to install.

British Pat. No. 993,207 discloses a rigid splash can having a composite wall construction to make it floatable. French Pat. No. 1,250,532 also discloses a splash can having composite or laminated walls.

U.S. Pat. No. 2,810,170 discloses an insert for a copper mold which controls splashing of molten metal; the patented splash can is not folded or deformed for insertion into the ingot mold.

U.S. Pat. No. 3,262,669 discloses a floating splash can which rises in an ingot mold as the level of molten metal rises. U.S. Pat. Nos. 2,907,083 and 2,910,747 discloses spiral splash mats which are placed on the mold stool prior to placement of the mold proper thereonto.

SUMMARY OF THE INVENTION

The problem of scab formation on ingots, due to splashing when filling a mold with molten metal, is recognized in the prior art referred to above. In summary, the problem arises at the beginning of a pour into a mold when the molten metal strikes the bottom or stool of the mold and splashes onto the side walls of the mold. The splashing continues until a sufficient amount of molten metal on the bottom of the mold is formed to provide a cushion to the inflowing molten metal. Because the walls of the mold are relatively cold, the splashing metal solidifies and oxidizes before the molten metal in the mold cavity reaches the level of the splashed metal. The oxidized particles form scabs on the ingot surface which, scabs must be removed to eliminate imperfections in the strip that is rolled from the ingot.

An object of the present invention is to eliminate such splashing during the initial part of the pouring or teeming procedure. This object is achieved by providing a cylinder made of sheet material compatible with the molten metal which sheet material is fitted within the mold cavity in such a way that the splashing molten metal impinges on the surface of the cylinder and not on the wall of the mold cavity.

Another object is to provide a splash can of the type referred to above which can be installed without hoisting the mold above the stool. The importance of achieving this object can be appreciated by realizing that a mold typically has a mouth of reduced diameter so that a rigid splash can cannot be introduced into the mold without hoisting the heavy mold above the stool. According to the present invention, the splash can is constructed of a strip of material formed into a cylinder having a peripheral distance somewhat less than the mold cavity but greater than the mouth. Because the can is formed by only one layer of material, it can be folded or deformed into a smaller shape for introduction through the mold mouth. The configuration of the cylinder permits the splash can to be folded without exceeding the elastic limit of the material so that, when the folded splash can is disposed in the mold, it can spring out into a cylindrical shape and perform its intended function.

A feature and advantage of employing a splash can formed of a single layer of strip material formed into a cylinder is that, when the can is folded into a condition for insertion through the mouth of an ingot mold, it is relatively lightweight and can be handled without employing heavy-duty hoisting equipment.

Another feature and advantage of employing a single layer cylindrical shape is that the splash can, when in place on the stool within the mold cavity, is very stable. This feature and advantage flows from the fact that a strip of metal having two opposed edges joined to one another imparts stress to the metal that inherently positions the strip in a cylindrical form.

The foregoing, together with other objects, features and advantages, will be more apparent after referring to the following specification and accompanying drawing.

DESCRIPTION OF THE PREFERRED EMBODIMENT

Figure 1:
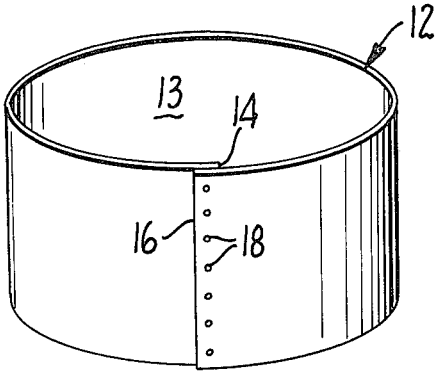
FIG. 1 is a perspective view of a splash can, according to the present invention, in an expanded condition.

Referring more particularly to the drawing, reference numeral 12 indicates a rectangular strip of steel or the like having opposed edges 14 and 16 which are parallel to one another and joined together so as to form a cylindrical shaped article. One suitable technique for joining edges 14 and 16 is to overlap the edges for a brief interval and install rivets 18 through the overlapped margins of the strip. The edges may also be joined together by other means, such as spot welding. The material of which strip 12 and rivets 18 is constructed is compatible with the molten material with which the device is used. In one device, designed according to the invention, low carbon steel with approximately 80% cold reduction was employed in connection with pouring steel of the type typically employed in forming cold rolled sheets of steel.

The outer dimensions of cylinder or splash can 12 are such as to fit within the mold cavity, the cavity being defined by a stool 20, and a mold section 22. More particularly, if the total length of the interior periphery of mold section 22 is C, it is desirable that cylinder 12 have a diameter less than $C/\pi$ in order that the cylinder can assume a generally cylindric condition within the mold cavity. Mold section 22 typically has an upward opened mouth 24 of reduced diameter and the diameter of cylinder 12 exceeds the diameter of the mouth to assure that all molten metal introduced to the mold flows interiorly of the cylinder.

Mold section 22 is typically of such weight that it can be positioned only by the employment of heavy-duty hoisting apparatus. To avoid the necessity of hoisting the mold section above stool 20 to permit insertion of cylinder 12, the invention provides for the movement of the cylinder to the folded condition shown in FIGS. 2 and 3. The folded cylinder or splash can is identified by the reference character 12' and is formed by partially flattening the cylinder by moving diametrically opposite portions thereof into mutual contact. The portions moved into contact with one another have a circumferential length less than half the total circumference of the cylinder so that the end portions 26 and 28 are folded into an arcuate configuration of sufficient radius to avoid deforming the material of strip 13 beyond its elastic limit. It will be noted that end portion 26 is exterior of the configuration. The folded cylinder 12' is retained in the folded condition by wrapping therearound a tension member 30 which can be steel wire, heavy cord, adhesive fiber tape, or the like. The tension member must have sufficient strength to retain the cylinder in the folded position 12', notwithstanding stress thereon due to the energy stored within the material when it is stressed to the folded position. In folding the cylinder, it is desirable to place the seam and rivets 18 at an interior location so that introduction of the folded cylinder into mouth 24 is not impeded.

Figure 2:
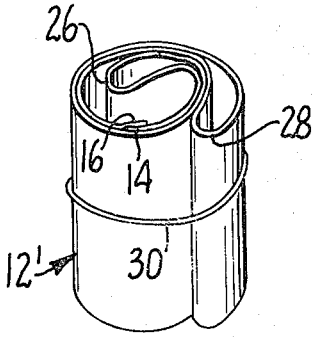
FIG. 2 is a perspective view of the splash can of FIG. 1 in the folded condition.

Referring to FIG. 2, the folded cylinder 12' is introduced through mouth opening 24 into the mold cavity. Because the folded cylinder 12' is made up of a single layer of material, the weight thereof is minimized so that introduction of the folded cylinder can be effected without heavy-duty hoisting equipment. When the folded cylinder is partially introduced into the mold cavity through mouth 24, tension member 30 is removed by cutting or untying the same. Because of the energy stored in the folded cylinder, it will expand in mouth 24 and frictionally engage the wall that defines the mouth to a degree sufficient to retain the cylinder within the mouth. With the cylinder so positioned, tension member 30 can be completely removed and discarded. The cylinder is then inserted fully into the mold cavity by pushing it downward. Because of the frictional engagement between the partially folded cylinder and the wall of mouth 24, the downward movement proceeds at a much slower rate than would obtain if the cylinder freely fell under the influence of gravity. The relatively slow downward movement assures that the cylinder reaches stool 20 in an upright position.

Figure 3:
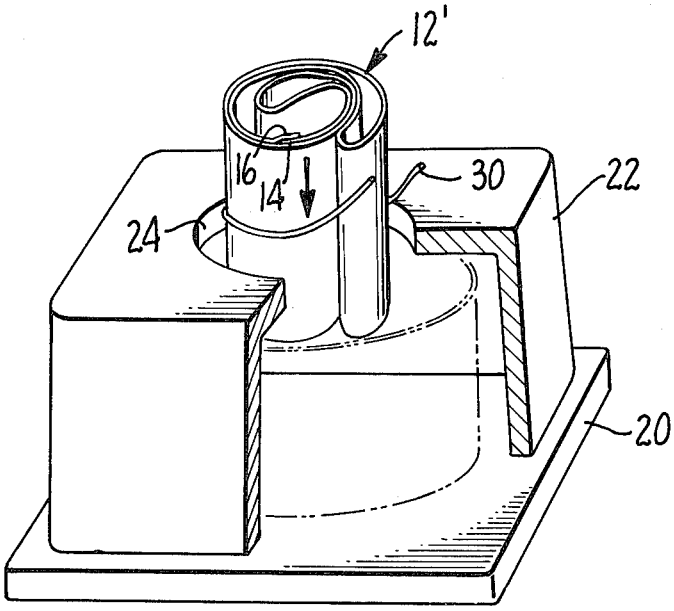
FIG. 3 is a perspective view of an ingot mold depicting the procedure for insertion of the folded splash can into the mold.
Figure 4:
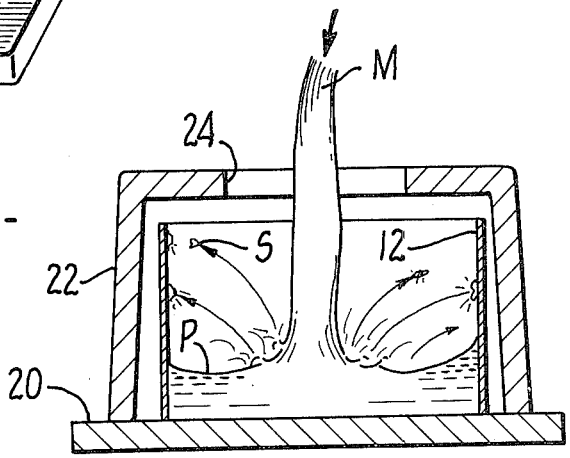
FIG. 4 is a cross-sectional elevation view of an ingot mold showing the splash can in place during pouring of molten metal into the mold.

When the cylinder 12 fully enters the mold cavity, it will complete its expansion into the cylindric form indicated by broken lines in FIG. 3 and by full lines in FIG. 1. Such expansion occurs because, in folding the cylinder into the position indicated at 12', the elastic limit of the material is not exceeded. After the cylinder has expanded within the mold cavity, it can, if necessary, be moved about within the mold so that the interior of the cylinder is in alignment with mouth 24. Thereafter, pouring of molten metal M can proceed. During the pouring or teeming of the molten metal into the mold cavity, splashes occurring along paths S will impinge on the wall of the cylinder rather than on the interior of the mold. After teeming has proceeded to such a degree that there is a pool or cushion P of molten material in the bottom of the mold cavity, the splashing is reduced or eliminated. At about the same time, the strip 13 melts and becomes part of the molten mass which, after cooling, becomes an ingot with virtually scab-free surfaces.

One cylinder designed according to the present invention employs low carbon steel in the full hard, unannealed state having a thickness of 0.015 inches. Such exemplary cylinder has a height of about 36 inches, a diameter of about 33 inches, and a weight of about 10 pounds. The exemplary cylinder can be folded for introduction through a mouth opening having a 15-inch diameter, without exceeding the elastic limit of the material. Moreover, the energy stored in the material, which is partially released when tension member 30 is severed, is sufficient to expand the cylinder in the mouth and create a frictional force against the mouth surface sufficient to position the cylinder in the mouth against the force of gravity. With the partially expanded cylinder in such position, a workman can use both hands to remove and discard the tension member. Then, the cylinder can be pushed downward; when about ⅔ to ¾ of the cylinder is within the mold cavity, the lower portion begins to expand so that when the cylinder falls free of engagement with the mouth, it will fall to the surface of stool 20 and remain in an upright position. Concurrent with the foregoing, the partially folded cylinder expands to a cylindric shape shown by broken lines in FIG. 3. The aforedescribed sequence assures proper orientation of the cylinder even in molds having heights up to 7 feet or more.

In using the splash can and in practicing the method of the invention, strip 13 is selected from a material that is compatible with the molten material to be placed in the mold. The width of the strip, i.e., the vertical or axial dimension of the cylinder, is selected in accordance with the vertical dimension of the mold cavity and the height of the ladle or nozzle from which molten metal M is dispensed into the cavity. The length of strip 13 is chosen to be no greater than C, C being the interior periphery of mold section 22. The length of the strip must be at least equal to, and preferably greater than, the circumferential length of mouth 24 in order that the splash can may be conveniently positioned in vertical alignment with the mouth and engage one or more portions of the mold cavity wall.

With the dimensions of the strip selected according to the above enumerated criteria, opposite edges 14 and 16 are joined, such as by overlapping the same and riveting the overlapping margins with rivets 18. It is desirable that the rivets be constructed of material that is compatible with the molten material to be teemed into the mold cavity. Next, the cylinder is partially flattened without distorting looped ends 26 and 28 beyond the elastic limit of the material of strip 13. Thereafter, the partially flattened cylinder is wound into a spiral shape and secured in such shape by a tension member 30 to form the folded member 12'. To afford insertion of the folded member 12', it is essential that the maximum diameter thereof is less than the diameter of mouth 24.

The folded member is then inserted approximately halfway into mouth 24 and tension member 30 is removed. Upon such removal of the tension member, the energy stored in strip 13 causes cylinder 12 to expand, which expansion is limited by the portion of mold section 22 that defines mouth 24. Thereafter, the partially folded section is totally inserted within the mold cavity, whereupon the energy stored in the material causes it to spring out into a cylindric shape. If the strip 13 is dimensioned as described above, it springs out into the cylindrical shape without further attention, whereupon teeming of molten metal M can proceed. As is the case in the above-identified prior art disclosures, the cylinder protects the interior walls of mold section 22 from splashing until such time as there is a cushion or pool P of molten metal that has a depth sufficient to prevent further splashing. At about the same time, cylinder 12 begins to melt and the mold is thereafter completely filled and cooled in accordance with conventional practices.

Thus, it will be seen that the present invention provides a splash can which employs substantially less material than prior art structures intended for the same purpose. Moreover, the splash can may be quickly and easily introduced into the mold cavity and assume the proper position with little or no further attention, thereby producing scab-free ingots in a superior and more economic manner than has heretofore been feasible. While one embodiment of the invention has been shown and described, it will be obvious that other adaptations and modifications can be made without departing from the true spirit and scope of the invention.

What is claimed is:

1. A splash can for use in pouring molten metal into an ingot mold of the type having an upward opened mouth of reduced diameter to receive molten metal, said mold defining a cavity having an interior periphery C, said splash can comprising a strip of metal material compatible with the molten metal, said strip being of substantially rectangular shape and having two opposed edges, means for joining said two opposed edges of said strip to form a cylinder comprised of a closed loop and having a diameter greater than the mold mouth and not substantially greater than $C/\pi$, said strip being resiliently coiled upon itself into a folded condition defining a double walled helix capable of resiliently returning to the original shape of the cylinder, said strip when in the folded condition being of a size suitable for introduction into said mold through said mouth, and means releasably retaining said cylinder in said folded condition.

2. A splash can, according to claim 1, wherein said retaining means includes an elongate tension member wrapped around said cylinder in the folded condition substantially midway between the vertical extremities thereof.

3. A splash can, according to claim 1, wherein said joining means comprises marginal portions of said strip edges being overlapped and a plurality of rivets extending through said overlapped marginal portions.

4. A splash can, according to claim 3, wherein said rivets are disposed in an interior position when said can is in the folded position so as to avoid impeding introduction of said can into said mouth.

5. A method for eliminating splashing of molten metal onto the interior walls of a mold cavity during pouring of the molten metal into the mold, the mold being of the type that has an upward opened mouth of reduced diameter, said method comprising the steps of providing a rectangular strip of metal compatible with the molten metal, joining two opposed edges of the metal at a seam to form a cylinder comprised of a closed loop, folding the cylinder for insertion into the mold through the mouth, said folding step being performed by coiling the cylinder upon itself so as to resiliently deform the cylinder into a double walled helix capable of resiliently returning to the original shape of the cylinder, providing an elongate tension member, installing the tension member in circumscribing relation to the folded cylinder to retain the cylinder in a folded condition, introducing the folded cylinder into the mold through the mouth, and removing the elongate tension member to enable the cylinder to resiliently unfold within the mold.

6. A method, according to claim 5, wherein said introducing step includes the steps inserting the folding cylinder into the mouth, interrupting said step when a lower portion of the folded cylinder is within the cavity and an upper portion of the folded cylinder is without the cavity, performing said tension member removing step during said interrupting step so that said cylinder expands to frictionally engage the portion to the mold that defines the mouth, then discarding the tension member, and then pushing the cylinder through the mouth into the cavity to complete the introducing step.

7. A method, according to claim 6, wherein said tension member installing step is performed by placing the tension member around the folded cylinder substantially midway between the vertical extremities thereof, and wherein said interrupting step is performed when said tension member is without the cavity.

8. a method, according to claim 5, wherein said folding step is performed so that the seam is interior the folded cylinder to avoid impeding performance of the introducing step.

* * * * *